US010508500B2

(12) United States Patent
Schoen

(10) Patent No.: US 10,508,500 B2
(45) Date of Patent: Dec. 17, 2019

(54) EARTH BORING TOOLS HAVING FIXED BLADES AND ROTATABLE CUTTING STRUCTURES AND RELATED METHODS

(71) Applicant: Baker Hughes, a GE company, LLC, Houston, TX (US)

(72) Inventor: William Schoen, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 133 days.

(21) Appl. No.: 15/691,219

(22) Filed: Aug. 30, 2017

(65) Prior Publication Data

US 2019/0063159 A1 Feb. 28, 2019

(51) Int. Cl.

| | |
|---|---|
| ***E21B 10/14*** | (2006.01) |
| ***E21B 10/16*** | (2006.01) |
| ***E21B 10/43*** | (2006.01) |
| ***E21B 10/48*** | (2006.01) |

(52) U.S. Cl.

CPC ..... *E21B 10/43* (2013.01); *E21B 10/14* (2013.01); *E21B 10/16* (2013.01); *E21B 10/485* (2013.01)

(58) Field of Classification Search

CPC ..... E21B 10/14; E21B 10/16; E21B 10/43; E21B 10/485

See application file for complete search history.

(56) References Cited

U.S. PATENT DOCUMENTS

| | | | |
|---|---|---|---|
| 6,241,034 | B1 | 6/2001 | Steinke et al. |
| 6,345,673 | B1 | 2/2002 | Siracki |
| 6,510,909 | B2 | 1/2003 | Portwood et al. |
| 6,561,291 | B2 | 5/2003 | Xiang |
| 6,823,951 | B2 | 11/2004 | Yong et al. |
| 7,621,345 | B2 | 11/2009 | Cepeda et al. |
| 7,677,333 | B2 | 3/2010 | Mensa-Wilmot |

(Continued)

FOREIGN PATENT DOCUMENTS

| | | |
|---|---|---|
| EP | 1071055 A1 | 1/2001 |
| JP | 2002-149824 A | 5/2002 |

(Continued)

OTHER PUBLICATIONS

Japanese Notice of Reasons for Refusal for Japanese Application No. 2015-041812 dated Jan. 23, 2019, 4 pages.

(Continued)

*Primary Examiner* — Daniel P Stephenson
(74) *Attorney, Agent, or Firm* — TraskBritt

(57) ABSTRACT

An earth-boring tool may include a body and at least one rotatable cutting structure assembly. The rotatable cutting structure assembly may include a leg, a rotatable cutting structure rotatably coupled to the leg, and a resistance actuator configured to impose rotational resistance on the rotatable cutting structure relative to the leg. An earth-boring to may include a plurality of rotatable cutting structure assemblies coupled to the bit body and a plurality of blades coupled to the body. A method of drilling a borehole may include rotating an earth-boring tool within the borehole, causing rotational resistance to be imposed on at least one rotatable cutting structure of the earth-boring tool, causing a blade of the earth-boring tool to be pushed into a sidewall of the borehole, and side cutting the sidewall of the borehole with the blade.

20 Claims, 11 Drawing Sheets

(56) References Cited

U.S. PATENT DOCUMENTS

| | | | | |
|---|---|---|---|---|
| 8,672,060 | B2 | 3/2014 | Centala et al. | |
| 9,033,069 | B2 | 5/2015 | Zhang | |
| 9,587,438 | B2 | 3/2017 | Chen | |
| 9,644,429 | B2 | 5/2017 | Mensa-Wilmot | |
| 9,903,162 | B2 | 2/2018 | Siracki et al. | |
| 2008/0021731 | A1 | 1/2008 | Rodgers | |
| 2010/0018777 | A1* | 1/2010 | Pessier | E21B 10/14 175/350 |
| 2011/0079444 | A1* | 4/2011 | Kulkarni | E21B 10/14 175/371 |
| 2011/0162893 | A1* | 7/2011 | Zhang | E21B 10/08 175/428 |
| 2013/0313021 | A1* | 11/2013 | Zahradnik | E21B 7/00 175/57 |
| 2016/0108680 | A1* | 4/2016 | Rothe | E21B 10/14 175/57 |
| 2016/0348440 | A1 | 12/2016 | Gan et al. | |
| 2017/0058609 | A1 | 3/2017 | Chen et al. | |
| 2017/0167201 | A1* | 6/2017 | Clausen | E21B 10/14 |
| 2019/0063159 | A1* | 2/2019 | Schoen | E21B 10/43 |

FOREIGN PATENT DOCUMENTS

| | | | |
|---|---|---|---|
| JP | 2004-164282 | A | 6/2004 |
| JP | 2016-136293 | A | 7/2016 |
| WO | 2003/102865 | A1 | 12/2003 |

OTHER PUBLICATIONS

International Written Opinion for International Application No. PCT/JP2015/081414; dated Feb. 2, 2016, 6 pages.

International Search Report for International Application No. PCT/JP2015/081414; dated Feb. 2, 2016, 1 page.

European Search Opinion for European Application No. 15884010.8 dated Feb. 18, 2019, 7 pages.

Chinese First Office Action for Chinese Application No. 201821137823.9 dated May 16, 2019, 3 pages.

Atallah et al., Behaviour Profiling with Ambient and Wearable Sensing, Proceedings of the International Workshop on Wearable and Implantable Body Sensor Networks, (Mar. 26, 2007), pp. 133-138.

* cited by examiner

EARTH BORING TOOLS HAVING FIXED BLADES AND ROTATABLE CUTTING STRUCTURES AND RELATED METHODS

TECHNICAL FIELD

This disclosure relates generally to earth boring tools having rotatable cutting structures. This disclosure also relates to earth-boring tools having blades with fixed cutting elements as well as rotatable cutting structures.

BACKGROUND

Oil wells (wellbores) are usually drilled with a drill string. The drill string includes a tubular member having a drilling assembly that includes a single drill bit at its bottom end. The drilling assembly may also include devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit and\or reamer attached to the bottom end of the drilling assembly is rotated by rotating the drill string from the drilling rig and/or by a drilling motor (also referred to as a "mud motor") in the bottom hole assembly ("BHA") to remove formation material to drill the wellbore.

BRIEF SUMMARY

Some embodiments of the present disclosure include earth-boring tools. The earth-boring tools may include a body, at least one rotatable cutting structure assembly coupled to the body, at least five blades attached to the body and extending at least from a nose region of the earth-boring tool and throughout a gage region of the earth-boring tool, and at least three blades attached to the body and extending from a center longitudinal axis of the body to at least the nose region of the earth-boring tool. In some instances, the at least one rotatable cutting structure assembly may include a leg extending from a gage region of the earth-boring tool, and a rotatable cutting structure rotatably coupled to the leg.

In additional embodiments, the earth-boring tool may include a body, two rotatable cutting structure assemblies coupled to the body, and a plurality of blades coupled to the body. Each rotatable cutting structure assembly may include a leg extending from a gage region of the body and a rotatable cutting structure rotatably coupled to the leg. The plurality of blades may include a first set of five blades attached to the body, wherein three blades of the first set of five blades are disposed angularly between the two rotatable cutting structure assemblies on a first lateral side of the body of the earth-boring tool, and wherein two blades of the first set of five blades are disposed angularly between the two rotatable cutting structure assemblies on an opposite, second lateral side of the body of the earth-boring tool, and a second set of three blades attached to the body and extending from a center longitudinal axis of the body to at least a nose region of the body.

Some embodiments of the present disclosure include a method of forming an earth-boring tool. The method may include forming a first set of at least five blades on a body of the earth-boring tool, and forming each blade of the first set of at least five blades to extend from a nose region of the earth-boring tool to at least a gage region of the earth-boring tool, forming a second set of at least three blades on the body, and forming each blade of the second set of at least three blades to extend from a center longitudinal axis of the earth-boring tool to at least the nose region of the earth-boring tool, and coupling at least one rotatable cutting structure assembly to the body.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
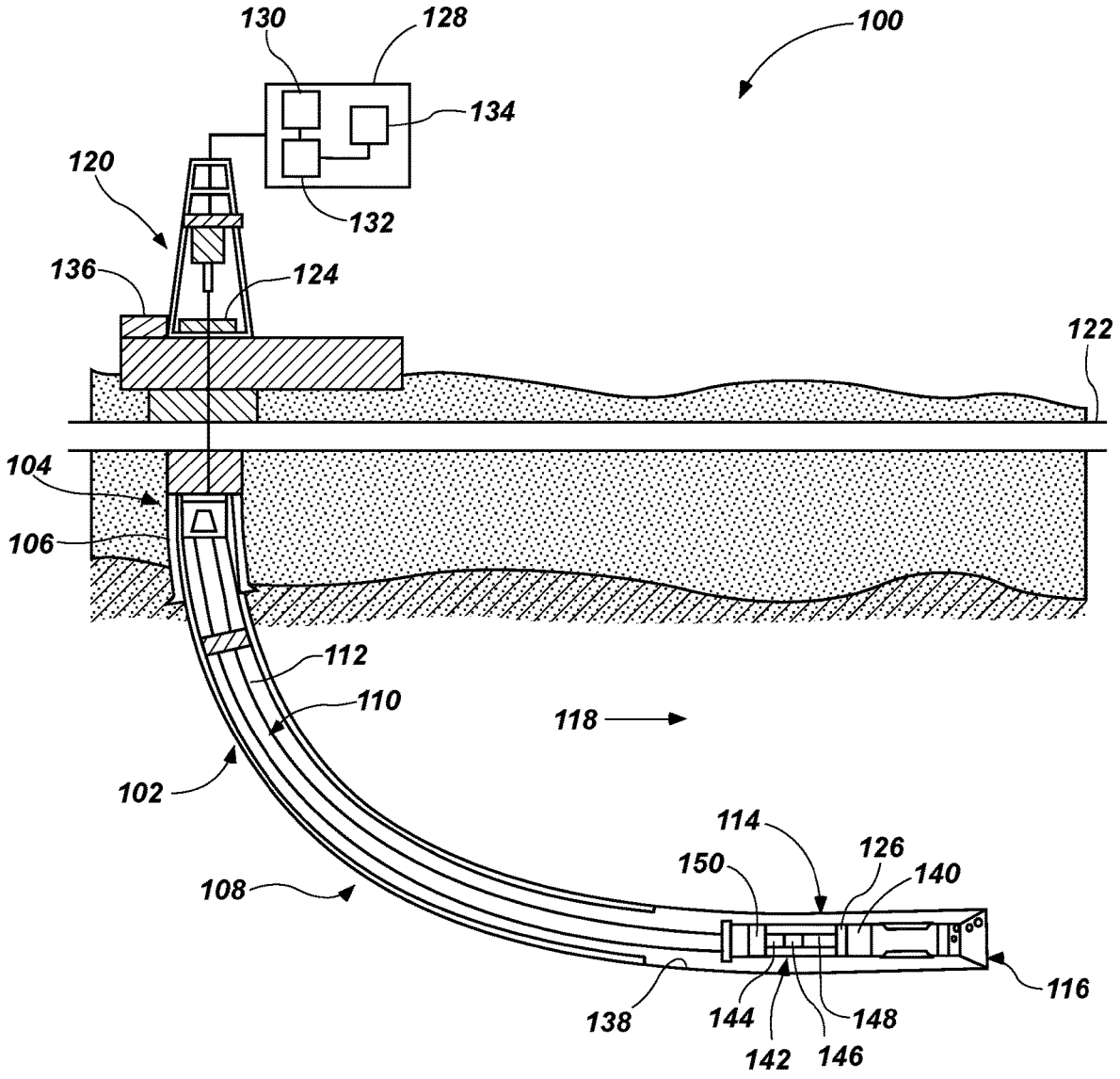
FIG. 1 is a schematic diagram of a wellbore system comprising a drill string that includes an earth-boring tool according to one or more embodiments of the present disclosure.

The illustrations presented herein are not actual views of any drill bit, roller cutter, or any component thereof, but are merely idealized representations, which are employed to describe the present invention.

As used herein, the terms "bit" and "earth-boring tool" each mean and include earth-boring tools for forming, enlarging, or forming and enlarging a borehole. Non-limiting examples of bits include fixed cutter (drag) bits, fixed cutter coring bits, fixed cutter eccentric bits, fixed cutter bi-center bits, fixed cutter reamers, expandable reamers with blades bearing fixed cutters, and hybrid bits including both fixed cutters and rotatable cutting structures (roller cones).

As used herein, the term "cutting structure" means and include any element that is configured for use on an earth-boring tool and for removing formation material from the formation within a wellbore during operation of the earth-boring tool. As non-limiting examples, cutting structures include rotatable cutting structures, commonly referred to in the art as "roller cones" or "rolling cones."

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to rotatable cutting structures, such as roller cones.

As used herein, any relational term, such as "first," "second," "top," "bottom," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool when as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Some embodiments of the present disclosure include a hybrid earth-boring tool having both blades and rotatable cutting structures. In particular, the earth-boring tool may include a first set of at least five blades and a second set of at least three blades. In some embodiments, the earth-boring tool may include at least five blades extending to a gage region of the earth-boring tool. Moreover, the earth-boring tool may include at least three blades extending to the center (i.e., a center longitudinal axis) of the earth-boring tool. In some instances, the first set of at least five blades may include two pairs of connected blades and a single distinct blade. For example, the first set of at least five blades may include a first pair of blades that are connected together via a first connector portion (e.g., a webbing between the pair of blades). The first set of at least five blades may further include a second pair of blades that are connected together via a second connector portion. Additionally, in one or more embodiments, at least one cutting element structure assembly may be disposed angularly between the first and second pairs of blades. In other words, the at least one cutting element structure assembly may be disposed between the first and second pairs of blades along a rotational direction of the earth-boring tool.

FIG. 1 is a schematic diagram of an example of a drilling system 100 that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the borehole 102 of a selected diameter in a formation 118.

The drill string 110 may extend to a rig 120 at surface 122. The rig 120 shown is a land rig 120 for ease of explanation. However, the apparatuses and methods disclosed equally apply when an offshore rig 120 is used for drilling boreholes under water. A rotary table 124 or a top drive may be coupled to the drill string 110 and may be utilized to rotate the drill string 110 and to rotate the drilling assembly 114, and thus the drill bit 116 to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a flash memory, a magnetic tape, a hard disk, and an optical disk. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank 208 and/or crown 210 of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

Figure 2:
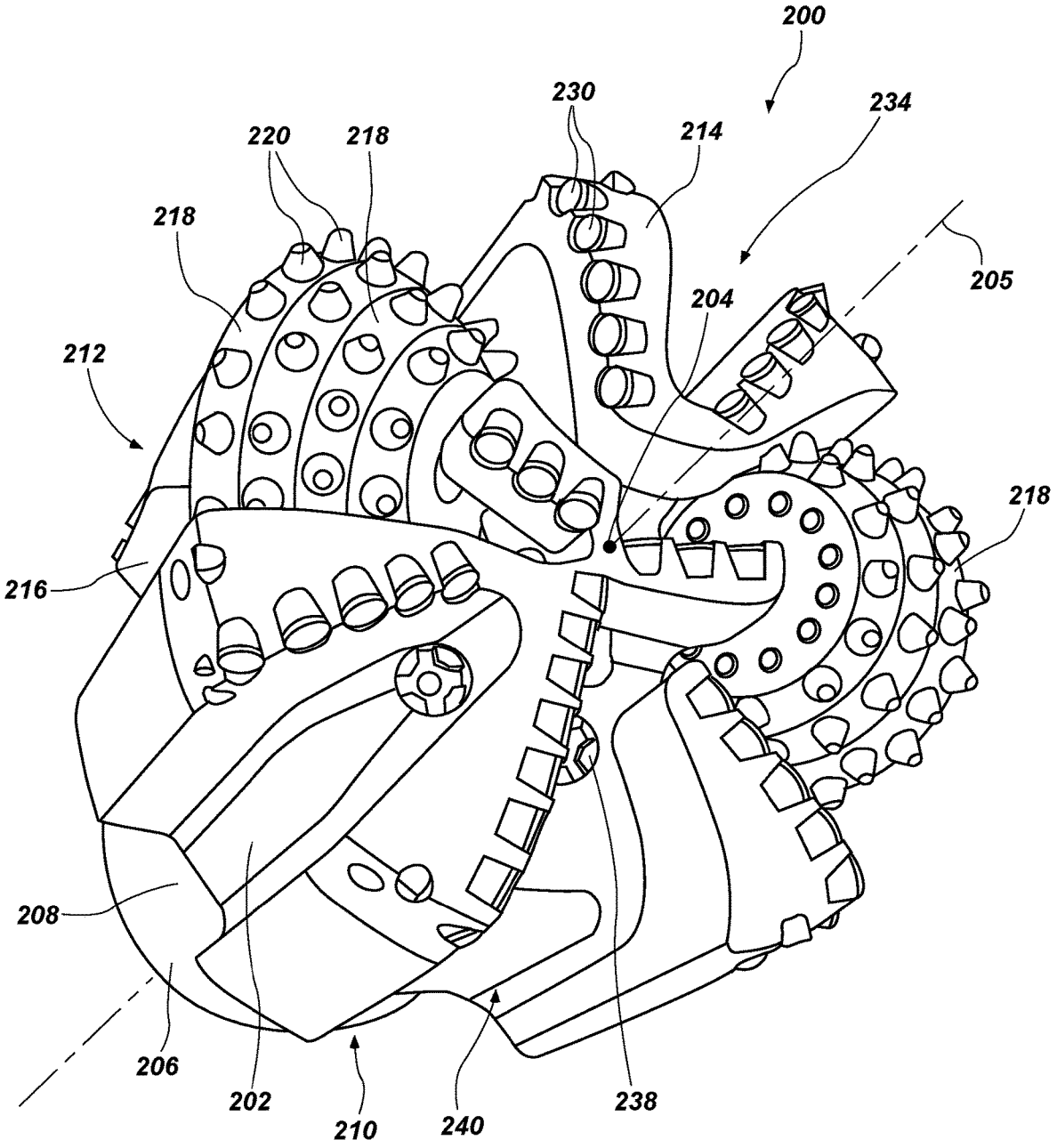
FIG. 2 is a bottom perspective view of an earth-boring tool according to one or more embodiments of the present disclosure.

FIG. 2 is a bottom perspective view of an earth-boring tool 200 that may be used with the drilling assembly 114 of FIG. 1 according to one or more embodiments of the present disclosure. The earth-boring tool 200 may include a drill bit having one or more rotatable cutting structures in the form of roller cones and one or more blades. For example, the earth-boring tool 200 may be a hybrid bit (e.g., a drill bit having both roller cones and blades) as shown in FIG. 2. Furthermore, the earth-boring tool 200 may include any other suitable drill bit or earth-boring tool 200 having one or more rotatable cutting structures and one or more blades for use in drilling and/or enlarging a borehole 102 in a formation 118 (FIG. 1).

The earth-boring tool 200 may comprise a body 202 including a neck 206, a shank 208, and a crown 210. In some embodiments, the bulk of the body 202 may be constructed of steel, or of a ceramic-metal composite material including particles of hard material (e.g., tungsten carbide) cemented within a metal matrix material. The body 202 of the earth-boring tool 200 may have an axial center 204 defining a center longitudinal axis 205 that may generally coincide with a rotational axis of the earth-boring tool 200. The center longitudinal axis 205 of the body 202 may extend in a direction hereinafter referred to as an "axial direction."

The body 202 may be connectable to a drill string 110 (FIG. 1). For example, the neck 206 of the body 202 may have a tapered upper end having threads thereon for connecting the earth-boring tool 200 to a box end of a drilling assembly 114 (FIG. 1). The shank 208 may include a lower straight section that is fixedly connected to the crown 210 at a joint. In some embodiments, the crown 210 may include a plurality of rotatable cutting structure assemblies 212 and a plurality of blades 214.

Each blade 214 of the plurality of blades 214 of the earth-boring tool 200 may include a plurality of cutting elements 230 fixed thereto. The plurality of cutting elements 230 of each blade 214 may be located in a row along a profile of the blade 214 proximate a rotationally leading face 232 of the blade 214. In some embodiments, the plurality of cutting elements 220 of the plurality of rotatable cutting structures 218 (e.g., roller cutters) and plurality of cutting elements 230 of the plurality of blades 214 may include PDC cutting elements 230. Moreover, the plurality of cutting elements 230 of the plurality of rotatable cutting structures 218 and plurality of cutting elements 230 of the plurality of blades 214 may include any suitable cutting element configurations and materials for drilling and/or enlarging boreholes.

The plurality of rotatable cutting structure assemblies 212 may include a plurality of legs 216 and a plurality of rotatable cutting structures 218, each respectively mounted to a leg 216. The plurality of legs 216 may extend from an end of the body 202 opposite the neck 206 and may extend in the axial direction. The plurality of blades 214 may also extend from the end of the body 202 opposite the neck 206 and may extend in both the axial and radial directions. Each blade 214 may have multiple profile regions as known in the art (cone, nose, shoulder, gage). In some embodiments, two or more blades 214 of the plurality of blades 214 may be located between adjacent legs 216 of the plurality of legs 216. In some embodiments, the plurality of rotatable cutting structure assemblies 212 may not include a plurality of legs 216 but may be mounted directed to the crown 210 on the body 202 of the earth-boring tool 200.

Fluid courses 234 may be formed between adjacent blades 214 of the plurality of blades 214 and may be provided with drilling fluid by ports located at the end of passages leading from an internal fluid plenum extending through the body 202 from a tubular shank 208 at the upper end of the earth-boring tool 200. Nozzles 238 may be secured within the ports for enhancing direction of fluid flow and controlling flow rate of the drilling fluid. The fluid courses 234 extend to junk slots 240 extending axially along the longitudinal side of earth-boring tool 200 between blades 214 of the plurality of blades 214.

Figure 3:
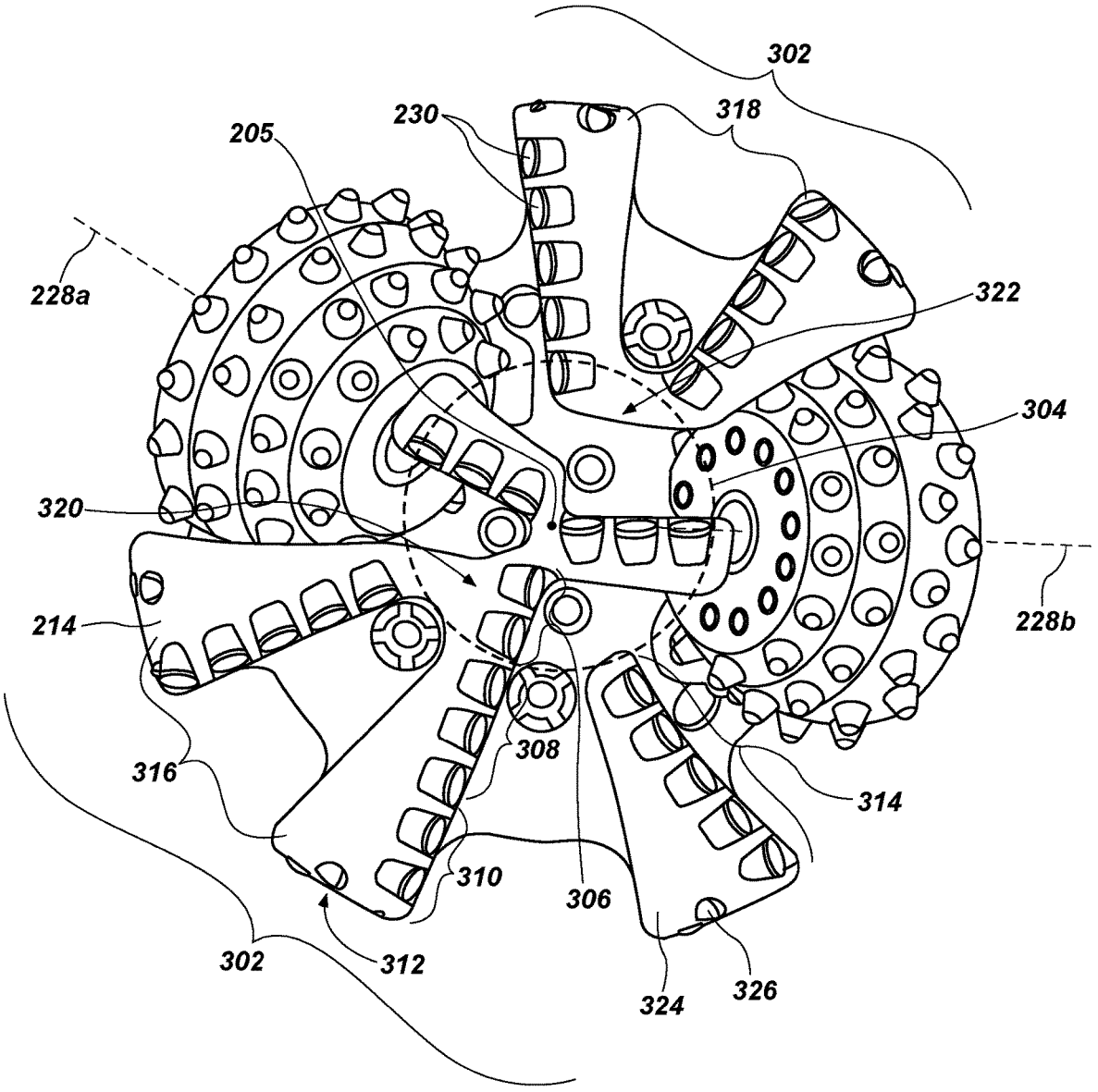
FIG. 3 is a bottom view of an earth-boring tool according to one or more embodiments of the present disclosure.

FIG. 3 is a top view of the earth-boring tool 200 of FIG. 2. As is known in the art, the earth-boring tool 200 (e.g., blades 214 of the earth-boring tool 200) may include a cone region 306, a nose region 308, a shoulder region 310, and a gage region 312. In some embodiments, the plurality of blades 214 may include a first set of at least five blades 302 and a second set of at least three blades 304. In some embodiments, each blade of the first set of at least five blades 302 may extend from at least the nose region 308 of the earth-boring tool 200 to at least a gage region 312 of the earth-boring tool 200. Furthermore, a cutting profile 314 (e.g., the plurality of cutting elements 230) of each blade 214 of the first set of at least five blades 302 may extend from at least the nose region 308 of the earth-boring tool 200 to at least the gage region 312 of the earth-boring tool 200. In other words, each blade of the first set of at least five blades 302 may include cutting elements 230 disposed throughout the nose region 308, shoulder region 310, and gage region 312 of the earth-boring tool 200. In view of the foregoing, earth-boring tool 200 may include at least five blades extending to the gage region 312 of the earth-boring tool 200.

In one or more embodiments, each blade of the second set of at least three blades 304 may extend from the center longitudinal axis 205 of the earth-boring tool 200, through a cone region 306 of the earth-boring tool 200, and into the nose region 308 of the earth-boring tool 200. Furthermore, a cutting profile 314 of each blade of second set of at least three blades 304 may extend from the cone region 306 of the earth-boring tool 200 and at least into the nose region 308 of the earth-boring tool 200. In view of the foregoing, earth-boring tool 200 may include at least three blades extending to the center (i.e., the center longitudinal axis 205) of the earth-boring tool 200. Furthermore, in some embodiments, one of the blades of the second set of at least three blades 304 may be part of (e.g., a portion) of one of the blades of the first set of at least five blades 302. For example, one of the blades of the second set of at least three blades 304 and one of the blades of the first set of at least five blades 302 may form a continuous blade extending from the center longitudinal axis 205 of the earth-boring tool 200 to the gage region 312 of the earth-boring tool 200.

Because the earth-boring tool 200 includes at least three blades extending to the center of the earth-boring tool 200, and because the earth-boring tool 200 include at least five blades extending to the gage region 312 of the earth-boring tool 200, the earth-boring tool 200 of the present disclosure may provide higher cutting element densities in comparison to conventional earth-boring tools or hybrid drill bits. The cutting element densities of the earth-boring tool 200 are described in greater detail below in regard to FIG. 9.

In some instances, the first set of at least five blades 302 may include two pairs of connected blades 316, 318 and a single distinct blade 324. For example, the first set of at least five blades 302 may include a first pair of blades 316 that are connected together via a first connector portion 320 (e.g., a webbing between the pair of blades). In some embodiments, the first connector portion 320 may connect ends of the first pair of blades 316 proximate the cone region 306 of the earth-boring tool 200. In particular, the first connector portion 320 may extend between the blades of the first pair of blades 316 such that the first pair of blades 316 form a generally V-shape. The first set of at least five blades 302 may further include a second pair of blades 318 that are connected together via a second connector portion 322. In some embodiment, the second connector portion 322 may also connect ends of the second pair of blades 318 proximate the cone region 306 of the earth-boring tool 200. In particular, the second connector portion 322 may extend between the blades of the second pair of blades 318 such that the second pair of blades 318 also form a generally V-shape. In some embodiments, the first and second pairs of blades 316, 318 may be pointed toward each other laterally across the earth-boring tool 200. For example, points of the V-shapes formed by the first and second pairs of blades 316, 318 may generally point toward each other.

In some embodiments, the first pair of blades 316 may include at least one blade of the second set of three blades 304. For example, one blade of the first pair of blades 316 may extend from the center longitudinal axis 205 to the gage region 312 of the earth-boring tool 200. Furthermore, in some embodiments, the first and second pairs of blades 316, 318 may be disposed on opposite lateral sides of the earth-boring tool 200. In some instances, the second pair of blades 318 may extend from the gage region 312 of the earth-boring tool 200 through the nose region 308 of the earth-boring tool 200. For example, the second pair of blades 318 may not substantially extend into the cone region 306 of the earth-boring tool 200. Moreover, the cutting profiles of the second pair of blades 318 may extend from the gage region 312 of the earth-boring tool 200 through the nose region 308 of the earth-boring tool 200 and may not substantially extend into the cone region 306 of the earth-boring tool 200.

As noted above, in some embodiments, the first set of at least five blades 302 may include the single distinct blade 324. The single distinct blade 324 may be disposed angularly adjacent to the first pair of blades 316. For example, the single distinct blade 324 may lead the first pair of blades 316 in a direction of rotation of the earth-boring tool 200. Furthermore, the single distinct blade 324 may extend from the gage region of the earth-boring tool 200 through the nose region 308 of the earth of the earth-boring tool 200. For example, the single distinct blade 324 may not substantially extend into the cone region 306 of the earth-boring tool 200. Moreover, the cutting profiles of the single distinct blade 324 may extend from the gage region 312 of the earth-boring tool 200 through the nose region 308 of the earth-boring tool 200 and may not substantially extend into the cone region 306 of the earth-boring tool 200.

Additionally, in one or more embodiments, at least one rotatable cutting structure assembly 212 may be disposed angularly between the first and second pairs of blades 316, 318. In other words, the at least one rotatable cutting structure assembly 212 may be disposed between the first and second pairs of blades 316, 318 along a rotational direction of the earth-boring tool 200. Each rotatable cutting structure 218 may be rotatably mounted to a respective leg 216 of the body 202. For example, each rotatable cutting structure 218 may be mounted to a respective leg 216 with one or more of a journal bearing and rolling-element bearing. Many such bearing systems are known in the art and may be employed in embodiments of the present disclosure Each rotatable cutting structure 218 may have a plurality of cutting elements 220 thereon. In some embodiments, the plurality of cutting elements 220 of each rotatable cutting structure 218 may be arranged in generally circumferential rows on an outer surface 222 of the rotatable cutting structure 218. In other embodiments, the cutting elements 220 may be arranged in an at least substantially random configuration on the outer surface 222 of the rotatable cutting structure 218. In some embodiments, the cutting elements 220 may comprise preformed inserts that are interference fitted into apertures formed in each rotatable cutting structure 218. In other embodiments, the cutting elements 220 of the rotatable cutting structure 218 may be in the form of teeth integrally formed with the material of each rotatable cutting structure 218. The cutting elements 220, if in the form of inserts, may be formed from tungsten carbide, and optionally have a distal surface of polycrystalline diamond, cubic boron nitride, or any other wear-resistant and/or abrasive or superabrasive material.

In some embodiments, each rotatable cutting structure 218 of the plurality of rotatable cutting structures 218 may have a general conical shape, with a base end 224 (e.g., wide end and radially outermost end 224) of the conical shape being mounted to a respective leg 216 and a tapered end 226 (e.g., radially innermost end 226) being proximate (e.g., at least substantially pointed toward) the axial center 204 of the body 202 of the earth-boring tool 200. In other embodiments, each rotatable cutting structure 218 of the plurality of rotatable cutting structures 218 may not have a generally conical shape but may have any shape appropriate for rotatable cutting structures 218.

Each rotatable cutting structure 218 of the plurality of rotatable cutting structures 218 may have a rotational axis 228*a*, 228*b* about which each rotatable cutting structure 218 may rotate during use of the earth-boring tool 200 in a drilling operation. In some embodiments, the rotational axis 228*a*, 228*b* of each rotatable cutting structure 218 of the plurality of rotatable cutting structures 218 may intersect the axial center 204 of the earth-boring tool 200. In other embodiments, the rotational axis 228*a*, 228*b* of one or more rotatable cutting structures 218 of the plurality of rotatable cutting structures 218 may be offset from the axial center 204 of the earth-boring tool 200. For example, the rotational axis 228*a*, 228*b* of one or more rotatable cutting structures 218 of the plurality of rotatable cutting structures 218 may be laterally offset (e.g., angularly skewed) such that the rotational axis 228*a*, 228*b* of the one of more rotatable cutting structures 218 of the plurality of rotatable cutting structures 218 does not intersect the axial center 204 of the earth-boring tool 200. In some embodiments, the radially innermost end 226 of each rotatable cutting structure 218 of the plurality of rotatable cutting structures 218 may be radially spaced from the axial center 204 of the earth-boring tool 200.

In some embodiments, the plurality of rotatable cutting structures 218 may be angularly spaced apart from each other around the center longitudinal axis 205 of the earth-boring tool 200. For example, a first rotational axis 228*a* of a first rotatable cutting structure 218 of the plurality of rotatable cutting structures 218 may be circumferentially angularly spaced apart from a second rotational axis 228*b* of a second rotatable cutting structure 218 by about 75° to about 180°. In some embodiments, the rotatable cutting structures 218 may be angularly spaced apart from one another by an acute angle. For example, in some embodiments, the rotatable cutting structures 218 may be angularly spaced apart from one another by about 120°. In other embodiments, the rotatable cutting structures 218 may be angularly spaced apart from one another by about 150°. In other embodiments, the rotatable cutting structures 218 may be angularly spaced apart from one another by about 180°. Although specific degrees of separation of rotational axes (i.e., number of degrees) are disclosed herein, one of ordinary skill in the art would recognize that the rotatable cutting structures 218 may be angularly spaced apart from one another by any suitable amount.

Referring still to FIG. 3, the first set of at least five blades 302 may include inserts 326 (e.g., tungsten carbide inserts) disposed proximate the gage region 312 of the earth-boring tool 200. The inserts 326 may trail cutting elements 230 of a respective blade 214 in a direction of rotation of the earth-boring tool 200. In some embodiments, the inserts 326 of each blade of the first set of at least five blades 302 may be configured to engage simultaneously at a depth of cut ("DOC") within a range of about 0.150 inch to about 0.175 inch. For example, the inserts 326 of each blade of the first set of at least five blades 302 may be configured to engage simultaneously at a DOC of about 0.166 inches. Furthermore, the inserts 326 may be offset from the gage region 312 of the earth-boring tool 200 by about 0.60 inch. In some instances, the inserts 326 may improve a durability of shoulder regions 310 of the blades 214 of the first set of at least five blades 302.

Figure 4:
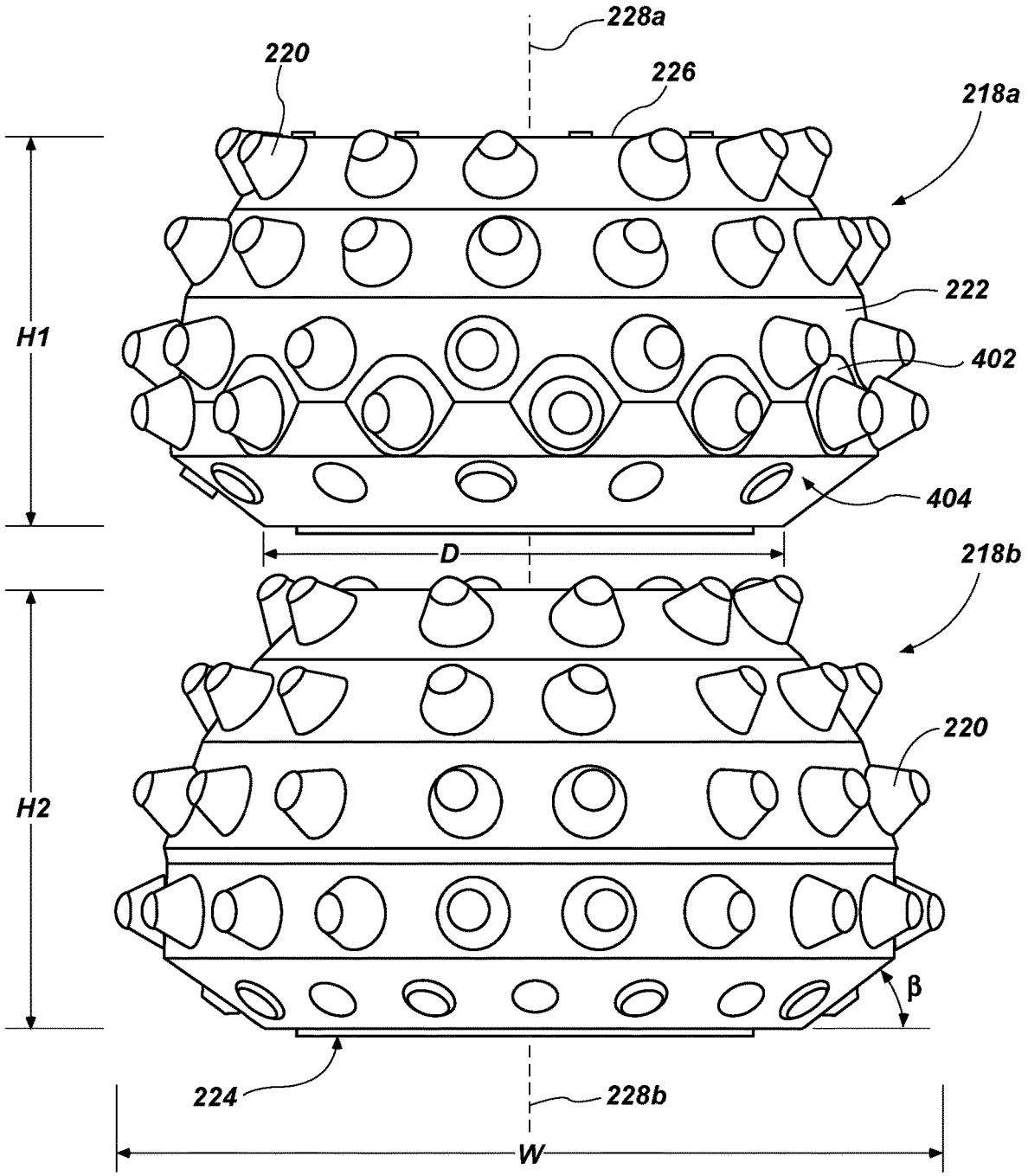
FIG. 4 is a side view of rotatable cutting structure of an earth-boring tool according to one or more embodiments of the present disclosure.

FIG. 4 is a side view of a first rotatable cutting structure 218*a* of the earth boring tool 200 and a second rotatable cutting structure 218*b* of the earth-boring tool 200 according to one or more embodiments of the present disclosure. As mentioned above, the both the first and second rotatable cutting structures 218*a*, 218*b* may have a plurality of cutting elements 220 disposed thereon. Furthermore, the plurality of cutting elements 220 of each rotatable cutting structure 218*a*, 218*b* may be arranged in generally circumferential rows on an outer surface 222 of the respective rotatable cutting structure 218*a*, 218*b*. Moreover, as noted above, both of the first and second rotatable cutting structures 218*a*, 218*b* may have a general truncated conical shape having the base end 224 (radially outermost end 224 when mounted to the earth-boring tool 200) and the opposite tapered end 226 (e.g., radially innermost end 226 when mounted to the earth-boring tool 200).

In some embodiments, one or more rows of cutting elements 220 of the first rotatable cutting structure 218*a* may be recessed relative to other rows of cutting elements 220. For example, each cutting element 220 of a respective row of cutting elements 220 may be disposed in a recess 402. In some instances, a row of cutting elements 220 most proximate the base end 224 of the first rotatable cutting structure 218 may be recessed relative to other rows of cutting elements 220. Conversely, the second rotatable cutting structure 218*b* may not include one or more recessed rows of cutting elements 220. Furthermore, in some instances, each cutting element 220 of the plurality of cutting elements 220 of both of the first and second rotatable cutting structures 218*a*, 218*b* may have a generally conical shape. For example, the plurality of cutting elements 220 of both of the first and second rotatable cutting structures 218*a*, 218*b* may not include wedge shapes.

In one or more embodiments, the base end 224 of both of the first and second rotatable cutting structures 218*a*, 218*b* may include a frusto-conical surface 404. Furthermore, both of the first and second rotatable cutting structures 218*a*, 218*b* may include a plurality of impact inserts 406 disposed on the frusto-conical surface 404 (e.g., inserted into a portion of the rotatable cutting structure 218 defining the frusto-conical surface 404).

Furthermore, in some embodiments, the second rotatable cutting structure 218*b* may have a greater height than the first rotatable cutting structure 218*a* along the rotational axes 228*a*, 228*b* of the first and second rotatable cutting structures 218*a*, 218*b*. For example, in some embodiments, the first rotatable cutting structure 218*a* may have a height H1 within a range of about 2.8 inches and about 3.2 inches, and the second rotatable cutting structure 218*b* may have a height H2 within a range of about 3.1 inches and about 3.5 inches. For instance, the first rotatable cutting structure 218*a* may have a height H1 of about 3.0 inches, and the second rotatable cutting structure 218*b* may have a height H2 of about 3.3 inches. Furthermore, both of the first and second rotatable cutting structures 218*a*, 218*b* may have a width W within a range of about 5.5 inches to about 6.5 inches. For example, both of the first and second rotatable cutting structures 218*a*, 218*b* may have a width W of about 6.0 inches. Moreover, the frusto-conical surface 404 of a respective rotatable cutting structure may define an angle β with a plane orthogonal to the axis of rotation of a respective rotatable cutting structure. In some embodiments, the angle β may be within a range of about 30° and about 40°. For example, the angle β may be about 36°. Additionally, the base end 224 of both of the first and second rotatable cutting structures 218*a*, 218*b* may have a diameter D within a range of about 3.5 inches and about 4.0 inches. For instance, the base end 224 may have a diameter of about 3.7 inches. In some embodiments, both the first and second rotatable cutting structures 218*a*, 218*b* may be coupled to a leg 216 (FIG. 2) of the earth-boring tool 200 via a 2.625 inch bearing (e.g., a journal bearing and/or rolling element bearing).

In view of the foregoing, the rotatable cutting structures (e.g., rotatable cutting structures 218*a*, 218*b*) of the present disclosure may provide advantages over conventional rotatable cutting structures. For example, the rotatable cutting structures of the present disclosure may exhibit a roll ratio within a range of 1.85 and 1.90 when used in an earth-boring tool (e.g., earth-boring tool 200). As used herein, the term "roll ratio" may refer to a number of times a rotatable cutting structure rotates relative to a full rotation of an earth-boring tool upon which the rotatable cutting structure is being used. Reducing the roll ratio may reduce wear on the cutting elements 220 of the rotatable cutting structure and may increase a life span of the cutting elements 220 and, as a result, the rotatable cutting structure.

Figure 5:
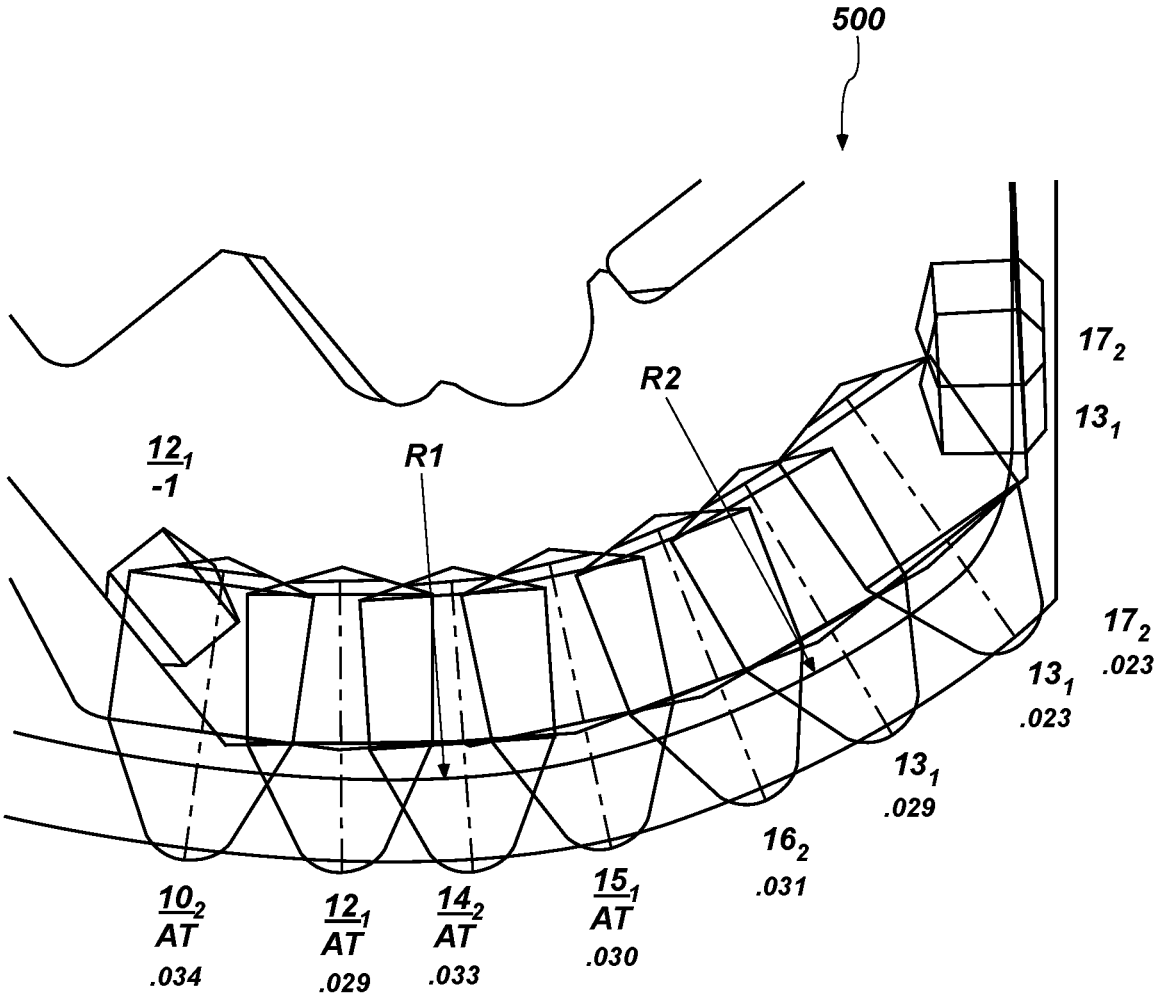
FIG. 5 is partial-schematic-cross-sectional view of a cutting profile of a rotatable cutting structure according to an embodiment of the present disclosure.

FIG. 5 shows a schematic view of a cutter profile 500 defined by the first and second rotatable cutting structures 218*a*, 218*b* (FIG. 4) of an earth-boring tool (e.g., earth-boring tool 200) according to one or more embodiments of the present disclosure. In some instance, the cutting elements 220 of the first and second rotatable cutting structures 218*a*, 218*b* (FIG. 4) may define a general radius of curvature (e.g., a curvature line extending through centers of each cutting element 220). Furthermore, in some embodiments, within a nose region 308 of the earth-boring tool, the radius of curvature R1 may be within a range of about 3.0 inches and about 4.0 inches. For example, the radius of curvature R1 may be about 3.5 inches. Moreover, within a shoulder region 310 of the blade 214, a radius of curvature R2 may be within a range of about 2.75 inches and about 3.0 inches. For example, the radius of curvature R2 may be about 2.875 inches.

Due to the cutting elements 220 defining the cutter profile 500 being aligned along the foregoing described lines of curvature, the rotatable cutting structures (e.g., the first and second rotatable cutting structures 218*a*, 218*b* (FIG. 4)) of the present disclosure may be advantageous over conventional rotatable cutting structures. For example, the rotatable cutting structures of the present disclosure may reduce wear on the cutting elements 220 of the rotatable cutting structures and may preserve cutting elements 220 along the shoulder region 310 and gage region 312 of the earth-boring tool 200. As a result, the rotatable cutting structures (e.g., first and second rotatable cutting structures 218*a*, 218*b* (FIG. 4)) of the present disclosure may improve an integrity and durability of an earth-boring tool.

Figure 6:
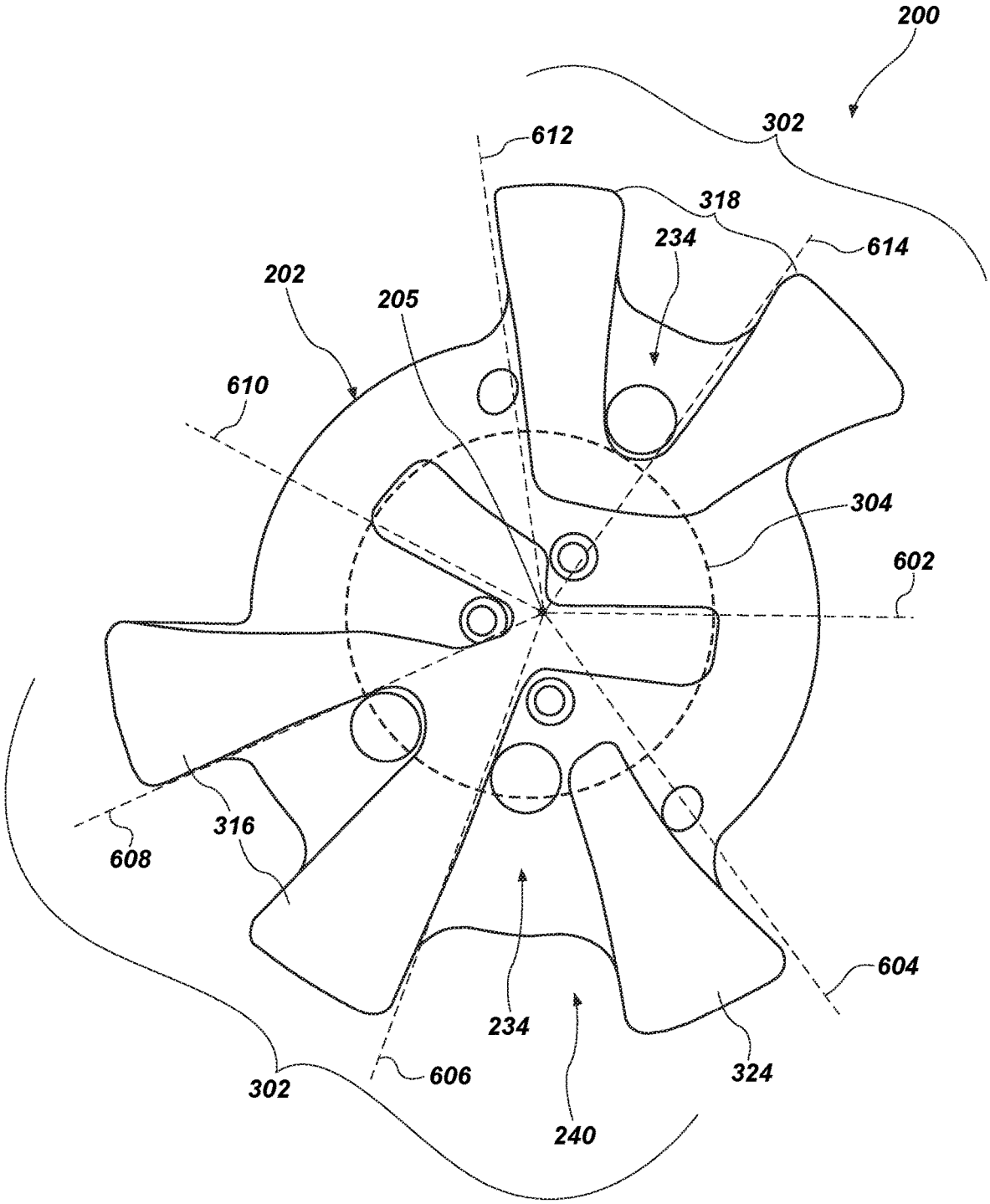
FIG. 6 is a bottom perspective view of an earth-boring tool according to one or more embodiments of the present disclosure.

FIG. 6 is a bottom view of a bit body and blades of an earth-boring tool 200 according to one or more embodiments of the present disclosure. The cutting elements 230 of the blades and the rotatable cutting structures 218*a*, 218*b* of the earth-boring tool 200 are removed to better show structure of the body 202 and blades 214 of an earth-boring tool 200. For purposes of the present disclosure, the blades of the earth-boring tool 200 depicted in FIG. 6 will be numbered and described with references to those numbers in order to facilitate description of certain aspects of the earth-boring tool 200. For example, the earth-boring tool 200 may include seven numbered blades.

With reference to FIG. 6, blade No. 1 may include a blade of the second set of at least three blades 304 and, as depicted in FIG. 6, may be oriented in a generally 3:00 o'clock position. Moving clockwise around the earth-boring tool 200, blade No. 2 may include a next rotationally adjacent blade (e.g., the single distinct blade 324) to blade No. 1. Additionally, blade No. 3 may include a next rotationally adjacent blade (e.g., a first blade of the first pair of blades 316) in the clockwise direction. Furthermore, blade No. 3 may include another blade of the second set of at least three blades 304. Moreover, blade No. 4 may include a next rotationally adjacent blade (e.g., a second blade of the first pair of blades 316) in the clockwise direction. Likewise, blade No. 5 may include a next rotationally adjacent blade in the clockwise direction and another blade of the second set of at least three blades 304. Blade No. 6 may include a next rotationally adjacent blade in the clockwise direction and a first blade of the second pair of blades 318. Also, blade No. 7 may include a next rotationally adjacent blade in the clockwise direction and a second blade of the second pair of blades 318.

In some embodiments, each blade of the seven blades may be spaced apart from each other angularly around the longitudinal axis of the earth-boring tool 200 by certain angles. For example, a plane 602 extending radially outward from the center longitudinal axis 205 and intersecting a leading face of blade No. 1 (referred to hereinafter as "leading plane") may be circumferentially angularly spaced apart from a leading plane 604 of blade No. 2 by about 40° to about 60°. For instance, in some embodiments, blade No. 1 and blade No. 2 may be angularly spaced apart from one another by about 54°. Additionally, the leading plane 604 of blade No. 2 may be circumferentially angularly spaced apart from a leading plane 606 of blade No. 3 by about 40° to about 60°. In particular, in some embodiments, blade No. 2 and blade No. 3 may be angularly spaced apart from one another by about 56°. Moreover, the leading plane 606 of blade No. 3 may be circumferentially angularly spaced apart from a leading plane 608 of blade No. 4 by about 40° to about 60°. For instance, in some embodiments, blade No. 3 and blade No. 4 may be angularly spaced apart from one another by about 55°. Furthermore, the leading plane 608 of blade No. 4 may be circumferentially angularly spaced apart from a leading plane 610 of blade No. 5 by about 40° to about 60°. For example, in some embodiments, blade No. 4 and blade No. 5 may be angularly spaced apart from one another by about 50°. Likewise, the leading plane 610 of blade No. 5 may be circumferentially angularly spaced apart from a leading plane 612 of blade No. 6 by about 40° to about 60°. For instance, in some embodiments, blade No. 5 and blade No. 6 may be angularly spaced apart from one another by about 58°. Also, the leading plane 612 of blade No. 6 may be circumferentially angularly spaced apart from a leading plane 614 of blade No. 7 by about 35° to about 50°. For example, in some embodiments, blade No. 6 and blade No. 7 may be angularly spaced apart from one another by about 42°. Although specific degrees of separation of leading planes (i.e., number of degrees) are disclosed herein, one of ordinary skill in the art would recognize that blades No. 1-7 may be angularly spaced apart from one another by any suitable amount.

As mentioned above in regard to FIG. 2, fluid courses 234 may be formed between adjacent blades (e.g., blades Nos. 2 and 3), and the fluid courses 234 may extend to junk slots 240 extending axially along the longitudinal side of earth-boring tool 200 between blades the earth-boring tool 200. As noted above, the fluid courses 234 may be formed between adjacent blades of the earth-boring tool 200 and may be provided with drilling fluid by ports located at the end of passages leading from an internal fluid plenum extending through the body 202 from a tubular shank 208 (FIG. 2) at the upper end of the earth-boring tool 200. In some embodiments, the fluid courses 234 of the earth-boring tool 200 of the present disclosure may provide an average cross-sectional area (e.g., an area through which drilling fluid and rock can travel) within a range of about 3.4 $in^2$ and about 4.2 $in^2$. For example, in some instances, the fluid courses 234 of the earth-boring tool 200 of the present disclosure may provide an average cross-sectional area of about 3.8 $in^2$. In some embodiments, the earth-boring tool 200 may exhibit an average volume of rock removed per blade ("VORR") of 3.1 $in^3$ when operated at a rate of penetration ("ROP") of 100 ft/hr and an RPM of 120. Accordingly, the earth-boring tool 200 provides an average ratio of the average cross-sectional area and the average VORR within a range of about 120% and about 125%. For example, the average ratio may be about 123%. In some embodiments, the fluid courses 234 and junk slots 240 may enable a fluid flow of at least 960 gallons per minute.

Figure 7:
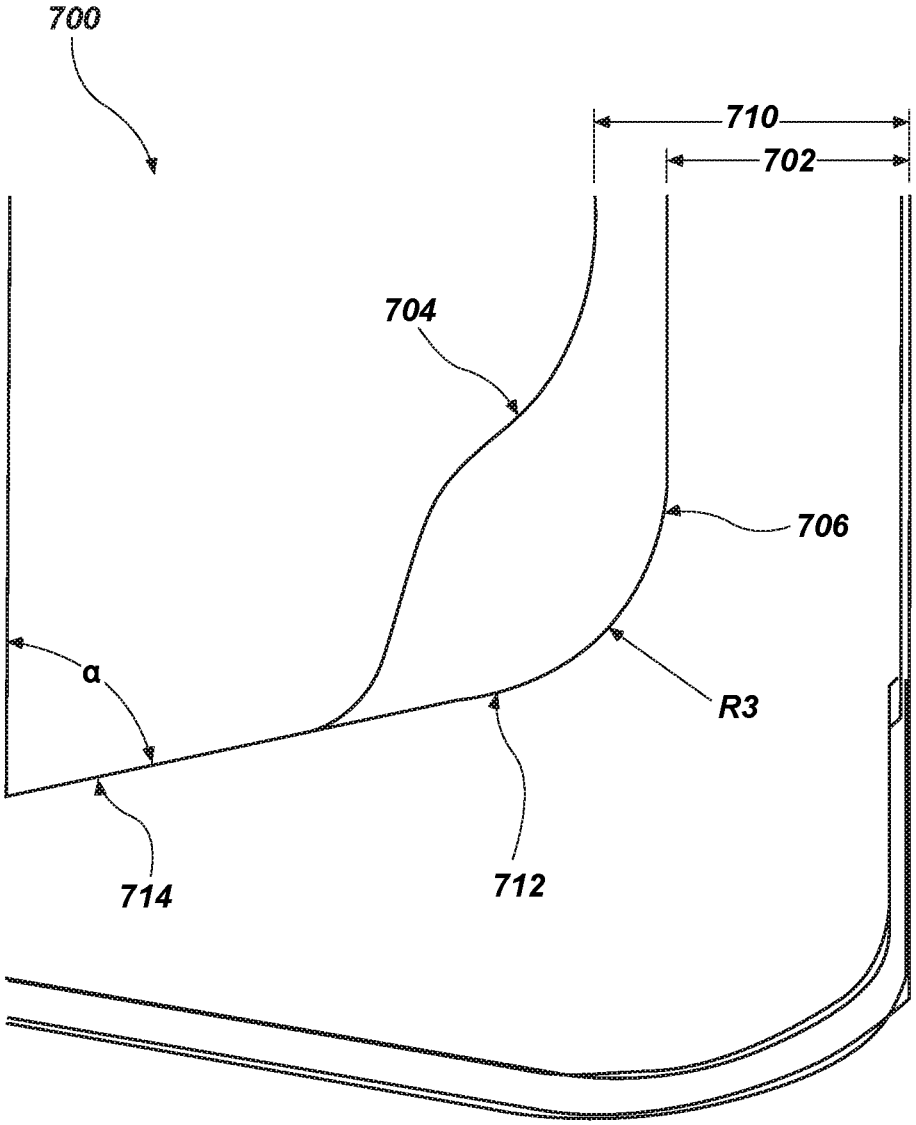
FIG. 7 is p partial-schematic-cross-sectional view of a fluid course and junk slots of an earth-boring tool according to one or more embodiments of the present disclosure.

FIG. 7 is a schematic side view of an earth-boring tool 200 and fluid courses and junk slots defined by the earth-boring tool 200 when rotating according to one or more embodiments of the present disclosure. For example, the earth-boring tool 700 may include a sub-assembly junk slot 704 and a secondary junk slot 706. In some embodiments, the secondary junk slot 706 of the earth-boring tool 700 may include reduced a standoff distance 702 (i.e., a distance between an inner surface of the secondary junk slot 706 and outer surface of a respective blade) in comparison to conventional earth-boring tools. For example, the standoff distance 702 may be within a range of about 1.4 to about 1.8 inches. For instance, the standoff distance 702 may be about 1.6 inches. The reduced standoff distance 702 may reduce a moment arm applied by a torque during operation on a respective blade, and accordingly, a stress on a respective blade may be reduced. Furthermore, in order to compensate for the reduced standoff distance 702, a size of the sub-assembly junk slot 704 of the earth-boring tool 700 may be increased. In some embodiments, the sub-assembly junk slot 704 may include another standoff distance 710 within a range of about 1.8 inches to about 2.4 inches. For example, the another standoff distance may be about 2.1 inches.

In some embodiments, the secondary junk slot 706 may include a curved portion 712 have a radius of curvature R3 within a range of about 1.3 inches and about 1.7 inches. For example, the curved portion 712 of the secondary junk slot 706 may have radius of curvature R3 of about 1.5 inches. Additionally, both the secondary junk slot 706 and the sub-assembly junk slot 704 may have a planar portion 714 proximate the nose region 308 and cone region 306 of the earth-boring tool 200. In some embodiments, a surface of the planar portion 714 may form an angle $\alpha$ with respect to the center longitudinal axis 205 of the earth-boring tool 200 (FIG. 2) within a range of about 75° and about 80°. For example, angle $\alpha$ may be about 78°.

Figure 8:
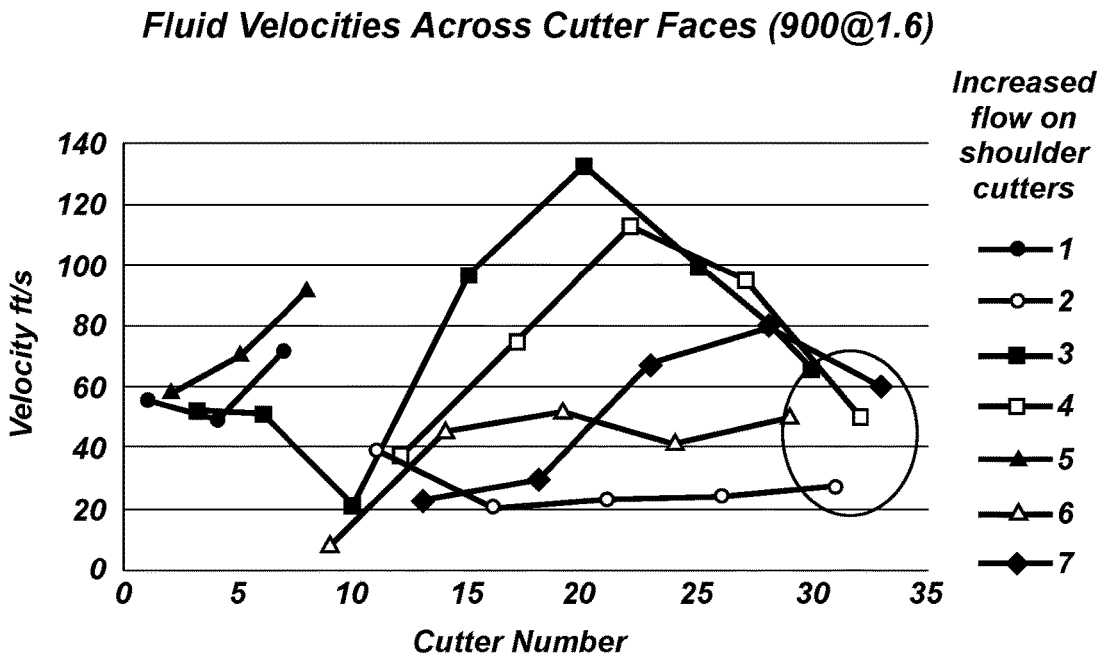
FIG. 8 is a graph showing fluid flow velocities across cutting elements of an earth-boring tool according to one or more embodiments of the present disclosure.

FIG. 8 is a graph showing fluid velocities across cutting elements of an earth-boring tool (e.g., earth-boring tool 200) according to one or more embodiments of the present disclosure. In the graph 800 shown in FIG. 8, the higher the number of a cutting element the farther the cutting element may be from a center longitudinal axis (e.g., center longitudinal axis 205) of the earth-boring tool. In comparison to conventional earth-boring tools, the fluid velocities across higher numbered cutting elements (e.g., cutting elements twenty through thirty-five) may be higher. For example, in some instance, the fluid velocities across the higher numbered cutting elements may be between 40% and 60% higher. In view of the foregoing, by maintaining higher fluid velocities at the higher numbered cutting elements, the earth-boring tool (e.g., earth-boring tool 200) of the present disclosure may provide a more effective and durable option for drilling in comparison to conventional earth-boring tools.

Figure 9:
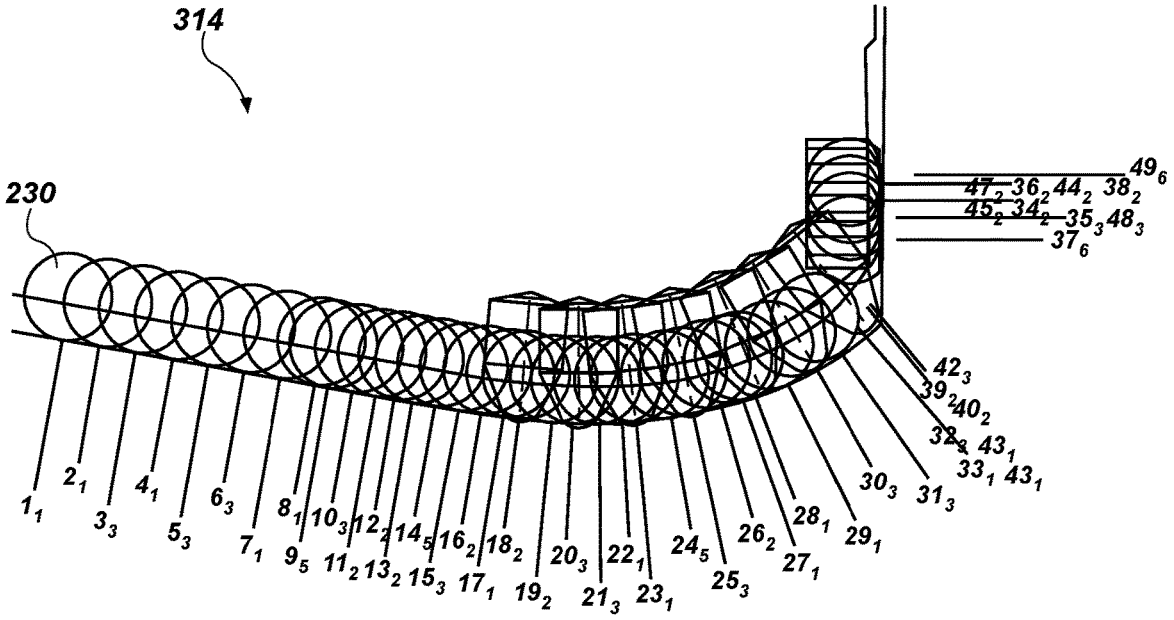
FIG. 9 is partial-schematic-cross-sectional view of a cutting profile of a blade of an earth-boring tool according to an embodiment of the present disclosure.

FIG. 9 is a schematic representation of a cutting profile 314 that may be defined by cutting elements 230 of the blades 214 (FIG. 2) of an earth boring tool 200 (FIG. 2) when in operation. In comparison to conventional earth-boring tools, a cutter density may be increased in the shoulder region 310 and the gage region 312 of the earth-boring tool 200 (FIG. 2). In some embodiments, within a radius of about 1 inch from the center longitudinal axis 205 (FIG. 2) of the earth-boring tool 200 (FIG. 2), the cutting profile 314 may include three cutting elements 230. Within a radius of about 1 inch to about 2 inches from the center longitudinal axis 205 (FIG. 2), the cutting profile 314 may include four cutting elements 230. Within a radius of about 2 inches to about 3 inches from the center longitudinal axis 205 (FIG. 2), the cutting profile 314 may include six cutting elements 230. Within a radius of about 3 inches to about 4 inches from the center longitudinal axis 205 (FIG. 2), the cutting profile 314 may include seven cutting elements 230. Within a radius of about 4 inches to about 5 inches from the center longitudinal axis 205 (FIG. 2), the cutting profile 314 may include six cutting elements 230. Within a radius of about 5 inches to about 6 inches from the center longitudinal axis 205 (FIG. 2), the cutting profile 314 may include seven cutting elements 230.

Figure 10:
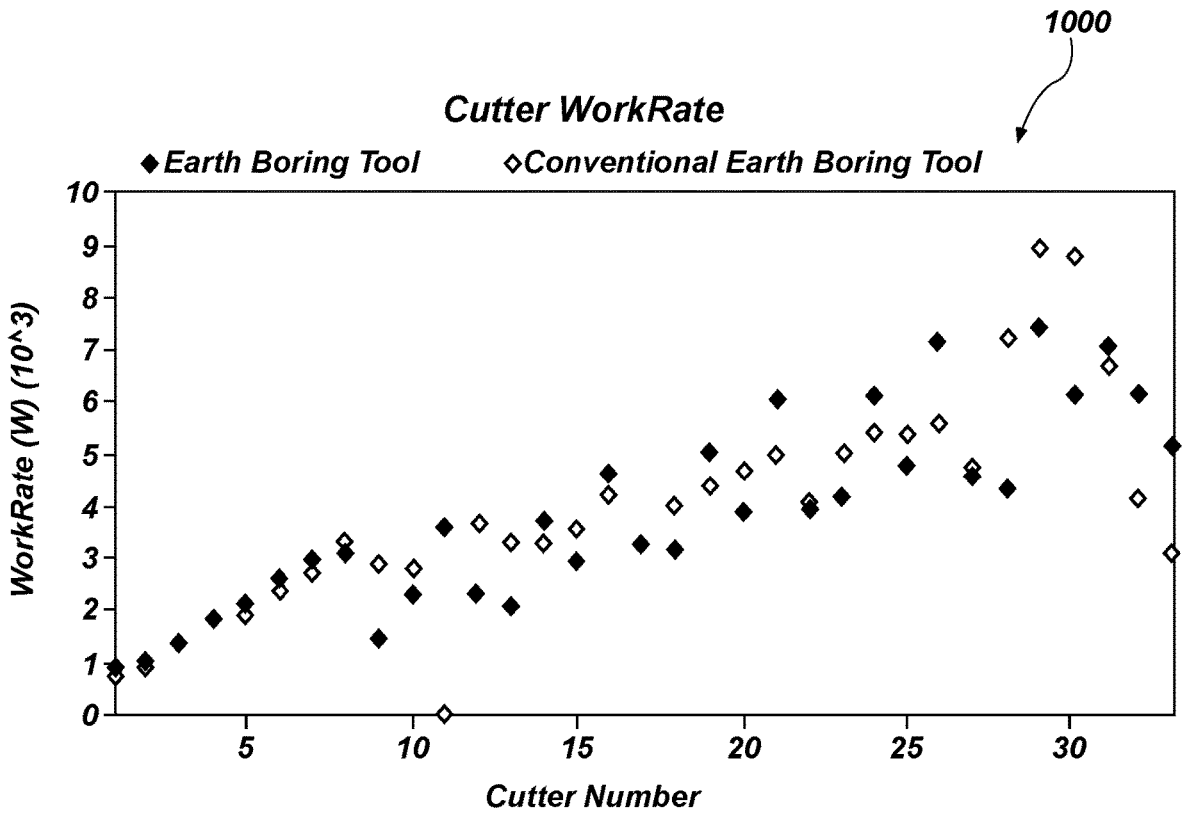
FIG. 10 is a graph showing workrates of cutting elements of an earth-boring tool according to one or more embodiments of the present disclosure.

FIG. 10 is a graph 1000 showing workrates (W) (WOB*RPM/(bit diameter)) of cutting elements of an earth-boring tool (e.g., earth-boring tool 200) of the present disclosure in comparison to workrates of cutting elements of conventional earth-boring tools. As shown in the graph 1000, cutting elements located nearer the center longitudinal axis of the earth-boring tool (i.e., located in the respective cone and nose regions of a blade) may be subjected to a lesser work rate than in other regions of the blade. Conversely, cutting elements located farther from the longitudinal axis of the earth-boring tool (i.e., located in the shoulder or gage region of the blade) may be subjected to a higher work rate than cutting elements in other regions of the blade.

Furthermore, as shown in graph 1000, the earth-boring tool (e.g., earth-boring tool 200 (FIG. 2)) of the present disclosure may not exhibit any spikes or significant deviations from a general upward trend of workrates of the cutting elements. Conversely, conventional earth-boring tools typically exhibit cutting elements that are subjected to significantly higher workrates (e.g., spikes in workrates) in comparison to surrounding cutting elements. By avoiding such spikes and/or significant deviations in workrates, the earth-boring tool of the present disclosure can reduce wear on cutting elements, and as such, can increase lifespans of cutting elements. Accordingly, the earth-boring tool of the present disclosure may lead to cost savings and a more durable earth-boring tool.

Figure 11:
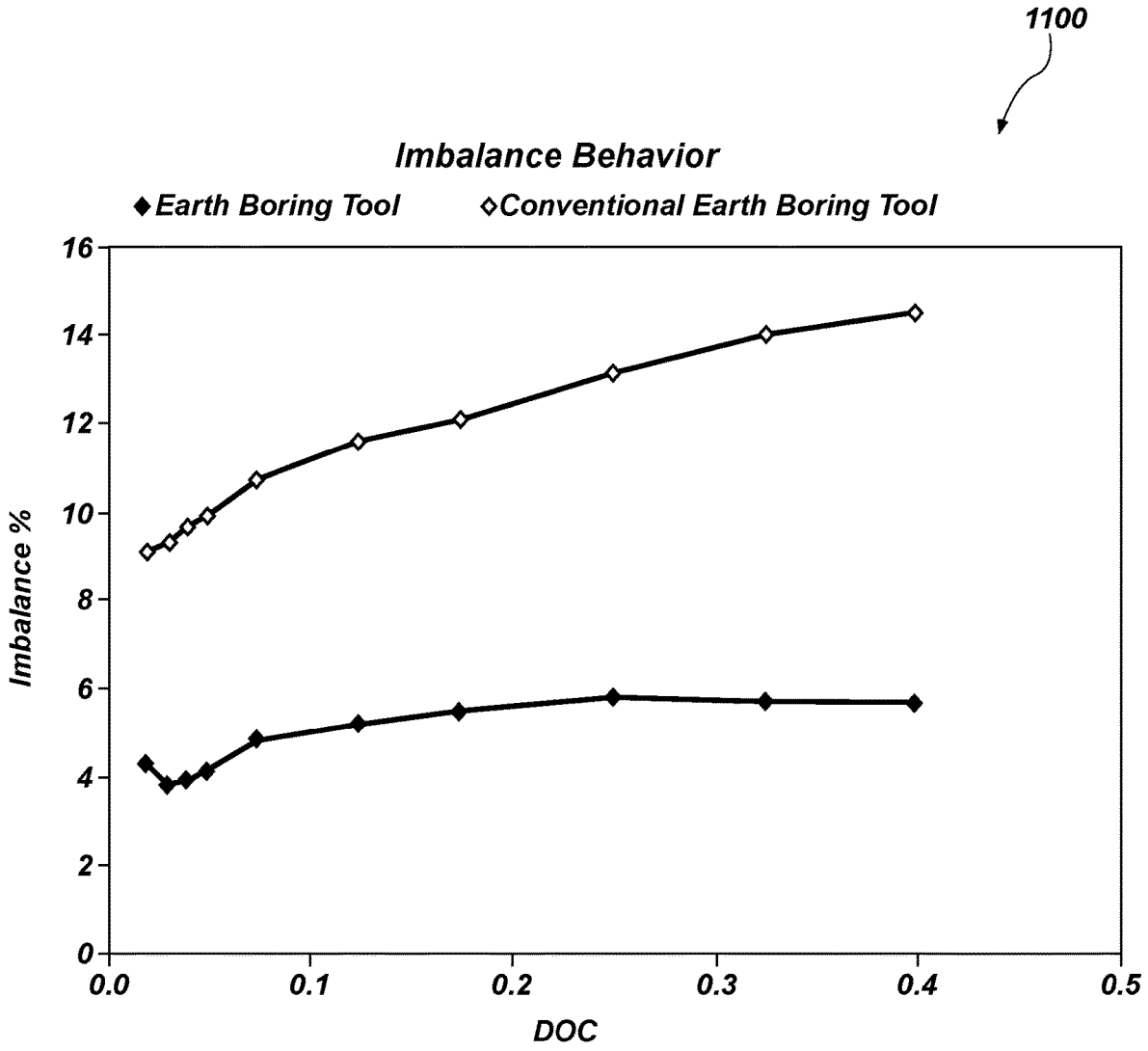
FIG. 11 is a graph showing imbalance percentages of an earth-boring tool according to one or more embodiments of the present disclosure.

FIG. 11 is a graph 1100 showing imbalance percentages of an earth-boring tool (e.g., earth-boring tool 200 (FIG. 2)) of the present disclosure in comparison to imbalance percentages of conventional earth-boring tools. For example, the imbalance percentages may refer to imbalanced forces experienced by an earth-boring tool while in operation resulting from non-symmetric distribution of drilling forces. As shown in FIG. 11, when in operation, the earth-boring tool of the present disclosure may experience imbalance percentages within a range of about 3.8% and about 6.0% while conventional earth-boring tools experience imbalance percentages within a range of about 9.0% to about 15%.

By reducing imbalance percentages, the earth-boring tool of the present disclosure may provide more reliable drilling. Furthermore, reducing imbalance percentages may result in increased lifespans of earth-boring tools. Moreover, reducing imbalance percentages may reduce imbalanced wear on the earth-boring tools and cutting elements.

Figure 12:
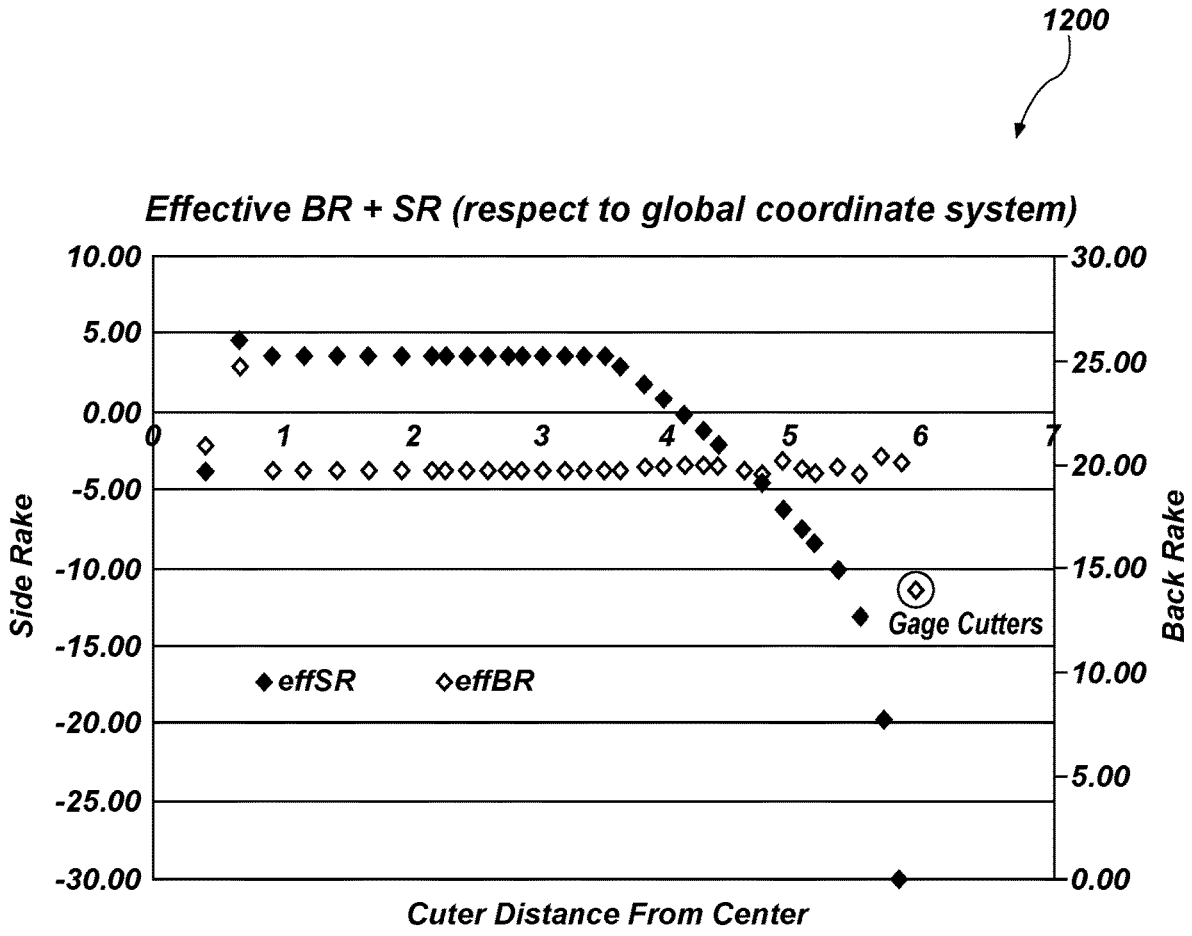
FIG. 12 is a graph showing back rakes and side rakes of cutting elements of an earth-boring tool according to one or more embodiments of the present disclosure.

FIG. 12 is a graph 1200 showing the effective back rakes and side rakes of cutting elements of the blades of the earth-boring tool according to one or more embodiments of the present disclosure. For example, as shown in graph 1200, in some embodiments, the back rake of the cutting elements of the earth-boring tool may be at least substantially uniform. Furthermore, the side rake of the cutting elements may gradually decrease upon reaching a shoulder and gage region of the earth-boring tool. In some embodiments, the side rake and back rake of the cutting elements may be optimized to increase and integrity and durability of the earth-boring tool.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. An earth-boring tool, comprising:

a body;

at least one rotatable cutting structure assembly coupled to the body and comprising:

a leg extending from a gage region of the earth-boring tool; and a rotatable cutting structure rotatably coupled to the leg;

at least five blades attached to the body and extending at least from a nose region of the earth-boring tool and throughout the gage region of the earth-boring tool, wherein the at least five blades comprise at least one pair of blades that are connected together via at least one connector portion; and at least three blades attached to the body and extending from a center longitudinal axis of the body to at least the nose region of the earth-boring tool.

2. The earth-boring tool of claim 1, further comprising at least two rotatable cutting structure assemblies.

3. The earth-boring tool of claim 2, wherein three blades of the at least five blades are disposed between the at least two rotatable cutting structure assemblies on a first lateral side of the body of the earth-boring tool, and wherein two blades of the at least five blades are disposed between the at least two rotatable cutting structure assemblies on an opposite, second lateral side of the body of the earth-boring tool.

4. The earth-boring tool of claim 1, wherein a first axis of rotation of a first rotatable cutting structure of a first rotatable cutting structure assembly defines an acute angle with a second axis of rotation of a second rotatable cutting structure of a second rotatable cutting structure assembly.

5. The earth-boring tool of claim 1, wherein the at least one pair of blades of the at least five blades comprises:

a first pair of blades that are connected together via a first connector portion proximate to the nose region of the earth-boring tool;

a second pair of blades that are connected together via a second connector portion proximate the nose region of the earth-boring tool; and a single distinct blade extending from the gage region of the body to the nose region of the earth-boring tool.

6. The earth-boring tool of claim 1, wherein at least one blade of the at least five blades extends from the gage region of the earth-boring tool to the center longitudinal axis of the body.

7. The earth-boring tool of claim 1, wherein the at least three blades are connected to each other at the center longitudinal axis of the body, and wherein one blade of the at least three blades comprise a portion of one blade of the at least five blades.

8. The earth-boring tool of claim 1, further comprising a plurality cutting elements secured within each blade of the earth-boring tool.

9. An earth-boring tool, comprising:

a body;

two rotatable cutting structure assemblies coupled to the body, each rotatable cutting structure assembly comprising:

a leg extending from a gage region of the body; and a rotatable cutting structure rotatably coupled to the leg; and a plurality of blades coupled to the body and comprising:

a first set of five blades attached to the body and extending at least from a nose region of the earth-boring tool and throughout the gage region of the earth-boring tool, wherein three blades of the first set of five blades are disposed angularly between the two rotatable cutting structure assemblies on a first lateral side of the body of the earth-boring tool, and wherein two blades of the first set of five blades are disposed angularly between the two rotatable cutting structure assemblies on an opposite, second lateral side of the body of the earth-boring tool;

a second set of three blades attached to the body and extending from a center longitudinal axis of the body to at least a nose region of the body.

10. The earth-boring tool of claim 9, wherein each blade of the first set of five blades and each blade of the second set of three blades comprise a plurality of cutting elements secured to the blade and oriented in a row proximate a leading face of the blade.

11. The earth-boring tool of claim 10, wherein each rotatable cutting structure of the two rotatable cutting structure assemblies defines a cutting profile have a radius of curvature within a range of about 2.8 inches and about 3.6 inches.

12. The earth-boring tool of claim 10, wherein a first axis of rotation of a first rotatable cutting structure of a first rotatable cutting structure assembly defines an angle of less than 180° with a second axis of rotation of a second rotatable cutting structure of a second rotatable cutting structure assembly.

13. The earth-boring tool of claim 10, wherein cutting elements proximate the gage region of a respective blade of the first set of five blades experiences a fluid velocity across the cutting elements proximate the gage region of the respective blade within a range of about 25 ft/s and about 65 ft/s when the earth-boring tool rotates at about 120 rotations per minute.

14. The earth-boring tool of claim 9, further comprising inserts secured to gage regions of each blade of the first set of five blades of the earth-boring tool and trailing a plurality of cutting elements of the blade in a direction of rotation of the earth-boring tool.

15. The earth-boring tool of claim 9, further comprising one or more junk slots defined between adjacent blades of the first set of five blades.

16. The earth-boring tool of claim 15, wherein the one or more junk slots provides a ratio of cross-sectional area to a volume of rock removed per blade within a range of about 120% to about 125%.

17. The earth-boring tool of claim 9, wherein the first set of five blades comprises:

a first pair of blades that are connected together via a first connector portion proximate the nose region of the earth-boring tool;

a second pair of blades that are connected together via a second connector portion proximate the nose region of the earth-boring tool; and a single distinct blade extending from the gage region of the earth-boring tool to the nose region of the earth-boring tool.

18. The earth-boring tool of claim 9, wherein each rotatable cutting structure of each of the two rotatable cutting structure assemblies exhibits a rotation ratio relative to each rotation of the earth-boring tool of about 1.87.

19. A method of forming an earth-boring tool, comprising:

forming a first set of at least five blades on a body of the earth-boring tool, and forming each blade of the first set of at least five blades to extend from a nose region of the earth-boring tool to at least a gage region of the earth-boring tool;

forming a second set of at least three blades on the body, and forming each blade of the second set of at least three blades to extend from a center longitudinal axis of the earth-boring tool to at least the nose region of the earth-boring tool; and coupling at least one rotatable cutting structure assembly to the body.

20. The method of claim 19, wherein forming the first set of at least five blades comprises:

forming a first pair of blades that are connected via a first connecter portion proximate to the nose region of the earth-boring tool;

forming a second pair of blades that are connected together via a second connector portion proximate the nose region of the earth-boring tool; and forming a single distinct blade extending from the gage region of the earth-boring tool to the nose region of the earth-boring tool.

* * * * *